US008556140B2

(12) United States Patent
Almoumen

(10) Patent No.: US 8,556,140 B2
(45) Date of Patent: Oct. 15, 2013

(54) MULTI-FUNCTIONAL BAG WITH CUSHION

(71) Applicant: Abdulmohsen A. Almoumen, Andalos (KW)

(72) Inventor: Abdulmohsen A. Almoumen, Andalos (KW)

( * ) Notice: Subject to any disclaimer, the term of this patent is extended or adjusted under 35 U.S.C. 154(b) by 0 days.

(21) Appl. No.: 13/714,678

(22) Filed: Dec. 14, 2012

(65) Prior Publication Data

US 2013/0161366 A1 Jun. 27, 2013

Related U.S. Application Data

(62) Division of application No. 12/328,069, filed on Dec. 4, 2008.

(51) Int. Cl.
*A45F 4/02* (2006.01)

(52) U.S. Cl.
USPC ..... 224/155; 224/153; 224/181; 224/575

(58) Field of Classification Search
USPC ..... 224/181, 186, 188, 190, 586, 153, 155, 224/156, 575–577; 2/69, 69.5, 86, 93, 94, 2/108, 209.13, 640, 417, 419–420, 652, 2/656–657; 5/640, 417, 419–420, 652, 5/656–657
See application file for complete search history.

(56) References Cited

U.S. PATENT DOCUMENTS

| | | | | |
|---|---|---|---|---|
| 3,576,704 | A * | 4/1971 | Groce et al. | 428/159 |
| 4,666,207 | A * | 5/1987 | Quartano | 297/229 |
| 6,421,834 | B2 * | 7/2002 | Kester | 2/94 |
| 7,058,997 | B1 * | 6/2006 | Klinger | 5/413 R |
| 2008/0201821 | A1 * | 8/2008 | Bryant | 2/84 |

* cited by examiner

*Primary Examiner* — Adam Waggenspack
(74) *Attorney, Agent, or Firm* — Lowe Hauptman & Ham, LLP

(57) ABSTRACT

A multi-functional backpack and pleated cushion assembly wherein the cushion is attached to and forms a part of the backpack. The backpack portion includes a front panel, a rear panel and a chamber defined between the front and rear panel for containing books, papers, food, etc. The longitudinally extending pleated cushion includes a plurality of laterally extending pockets filled with a sponge like material. The pleated cushion is foldable along the pleats or may be rolled up into a compact roll for carrying.

2 Claims, 4 Drawing Sheets

MULTI-FUNCTIONAL BAG WITH CUSHION

CROSS REFERENCE TO RELATED APPLICATION

The present application is a Divisional of U.S. patent application No. 12/328,069, filed Dec. 4, 2008, the disclosure of which is herein incorporated by reference in its entirety.

FIELD OF THE INVENTION

This invention relates to a multi-functional backpack and pleated cushion attached thereto and more particularly to a multi-functional backpack and pleated cushion that is constructed and dimensioned to fold along one or more of the pleats and to be rolled up and carried on the top or bottom of the backpack.

BACKGROUND FOR THE INVENTION

Backpacks are commonly used by students and others who carry even moderately heavy books, papers and other items. Backpacks are also favored by many who transport relatively light loads but prefer to do so in a hands free or relatively unobstructed manner. Backpacks are also favored by individuals who may be required to sit for relatively long periods of time without the benefit of a comfortable chair and at times without even a bench or clean and dry surface to sit on.

In view of the increased popularity of backpacks and the need for creature comfort by a large number of students and others who are frequently forced to sit on uncomfortable wood or metal chairs, there have been a number of attempts to combine the benefits of a backpack with a built-in ground cloth or padded cushion.

For example, a U.S. Pat. No. 5,558,570 of Zirbel discloses a combination backpack and seat device which includes a frame separable into two members. The first member generally supports the backpack of the disclosure and also provides a back rest for a seated user. The second member stores easily within the pouch of the backpack and can be attached to form an L-shaped structure. Once the second member of the frame is connected to the first member, a cushion can be lowered to form a low profile seat which can be used for sitting. The disclosure also provides for comfort and ease in assembly, as well as a lightweight unit which can be easily transported.

A further approach to a combination backpack and seat cushion is disclosed by a U.S. patent of Brougher, U.S. Pat. No. 6,244,481. As described therein, a seat cushion comprises a large pad with a plurality of pocketed flaps attached thereto and foldable on the pad perimeter over the pad for carrying or away from the pad availing the pad as an unobstructed seat cushion. The flap pockets are directed inward toward the pad such that when the pad is in use as a cushion on a hard chair, such as a student's desk, the pockets are directed toward the user for convenient access. The most outside flap shares a zipper with the pad and when closed defines a cavity within in which the other flaps are secured, folded alternately over the pad. The cushion is transported on the user's back in the normal manner of a backpack by two arm loops through which the user may place his arm and shoulders, respectively, thus bringing the pad against the user's back as a cushion.

A more recent approach to a combination backpack and cushion device is disclosed in a U.S. Patent Application Publication of Gillespie, No. 2007/0084891. The Gillespie Publication discloses a combination backpack and seat cushion including cushion operatively connected to a pair of functional backpack sections. The cushion is sandwiched between the backpack sections at a first configuration and further separates the backpack sections into a more linear configuration at a second configuration. The backpack sections include compartments for carrying books or other articles. The invention may be carried as a traditional backpack at the first configuration. At the second configuration, the cushion may be placed on a chair seat and back rest while the connected backpack sections may be strapped out of the way below and behind the chair.

Notwithstanding the above it is presently believed that there is a need and a potential commercial market for a multi-functional backpack with a pleated cushion attached thereto in accordance with the present invention. It is believed that there is a need and a potential market for these improved backpacks and cushion assemblies because they are multi-functional, applicable for chairs of various designs, chase lounges, usefulness on the ground and applicable as an umbrella which is relatively unaffected by wind, rain, sleet and hail. In addition, the backpack and pleated cushion assemblies in accordance with the present invention are rugged, durable, compact and relatively easy to securely attach to a chair or the like and to manufacture at a competitive cost.

Further, it is presently believed that the backpack and pleated cushions in accordance with the present invention are applicable to buses and bus station seating, trains and train station seats, restaurant seating, shopping center seating, school desks and chairs, folding metal chairs, hospital seating, stadium seating, seats on the ground or benches, seating on the floor or seating on the grass, on plastic chairs, cement and the like. The backpack and pleated cushions also protect a user from wet, dirty, cold, hot, hard and uncomfortable surfaces.

BRIEF SUMMARY OF THE INVENTION

In essence the present invention contemplates a multi-functional backpack and pleated cushion attached thereto. The backpack and pleated cushion comprises a pack assembly including a front panel, a back panel and a chamber defined between the front panel and the back panel. Further, the front panel and back panel each have a top, a bottom and two sides. A pair of shoulder straps secured to the backpack such that with the straps positioned over the shoulders of an individual the front panel and pack panel are generally parallel to the back of the individual.

In addition to the above, a longitudinally extending pleated cushion is attached to the pack assembly and includes a plurality of laterally extending fillable pockets and a plurality of laterally extending pleats separating the fillable pockets from one another. The pleated cushion is constructed and dimensioned to be folded on the pleats into a plurality of shapes and to be rolled into a compact role for carrying as part of a backpack. The pockets are also filled with an elastomer filling such as a medium density sponge like material. Further, the pleated cushion includes a plurality of strap means for attaching the cushion to a structure and for maintaining the cushion in a rolled up position.

The invention will now be described in connection with the accompanying drawings wherein like reference numerals have been used to indicate like parts.

DESCRIPTION OF THE PREFERRED EMBODIMENTS OF THE INVENTION

Figure 1:
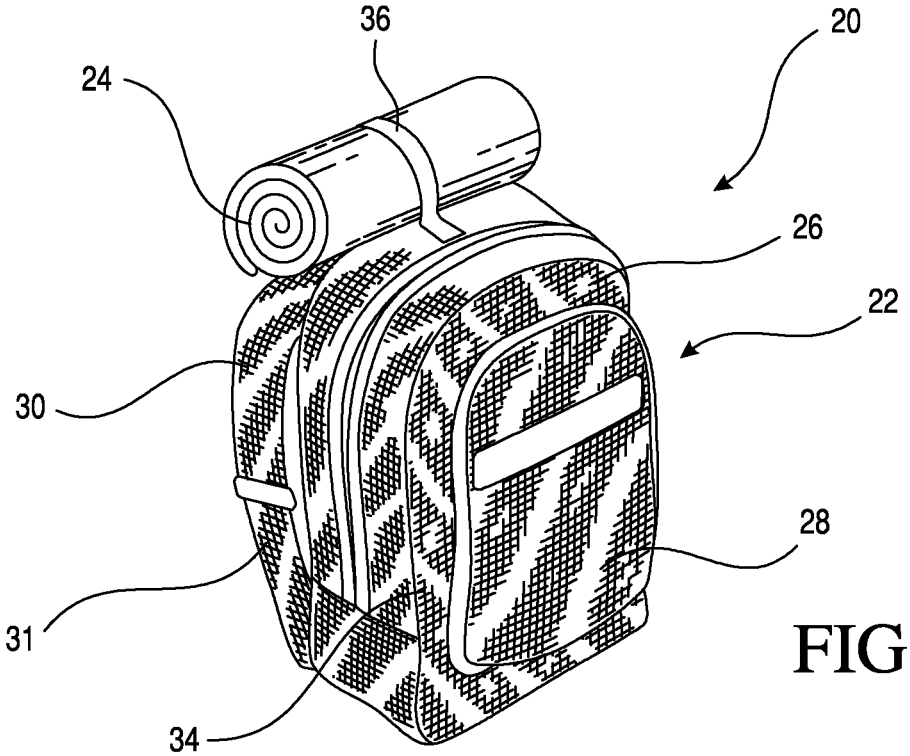
FIG. 1 is a perspective view of a backpack with a pleated cushion attached to the top of a rear panel of the backpack.
Figure 2:
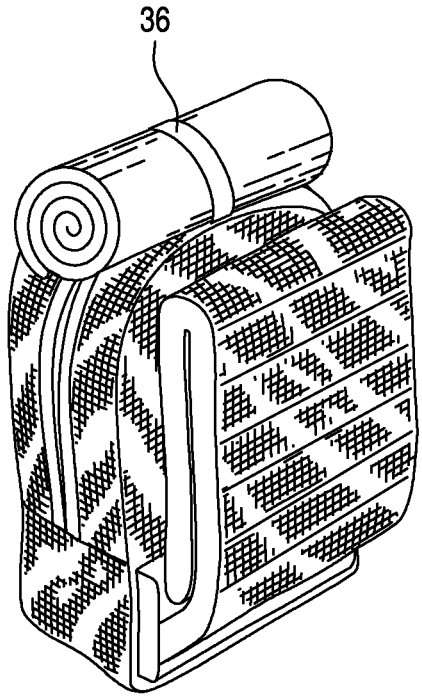
FIG. 2 is a perspective view of a backpack with a pleated cushion attached to the bottom of a rear panel of the backpack.

As shown in FIGS. 1 and 2, a multi-functional backpack and pleated cushion attached thereto 20 in accordance with a preferred embodiment of the invention includes a pack assembly 22 and a pleated cushion 24. As shown, the pack assembly 22 includes a front panel 26 behind an outer front pouch 28 and a back panel 30. The pack assembly also includes a pair of shoulder straps 31 and 32 in a conventional manner.

As shown in FIG. 1, the backpack and pleated cushion 20 include a pack assembly 22 of basically conventional design with the pleated cushion 24 attached to a top portion of the backpack 30. In this embodiment of the invention, the pleated cushion is attached to the upper portion of the back panel 30 by a row of stitches 35 (See FIG. 3). In FIG. 2 the same backpack is shown in perspective as taken from the bottom of the backpack and cushion 20 and shows the pleated cushion 24 attached to a bottom edge of the panel 30 and rolled up for storage on the bottom of the pack assembly 22.

Figure 2A:
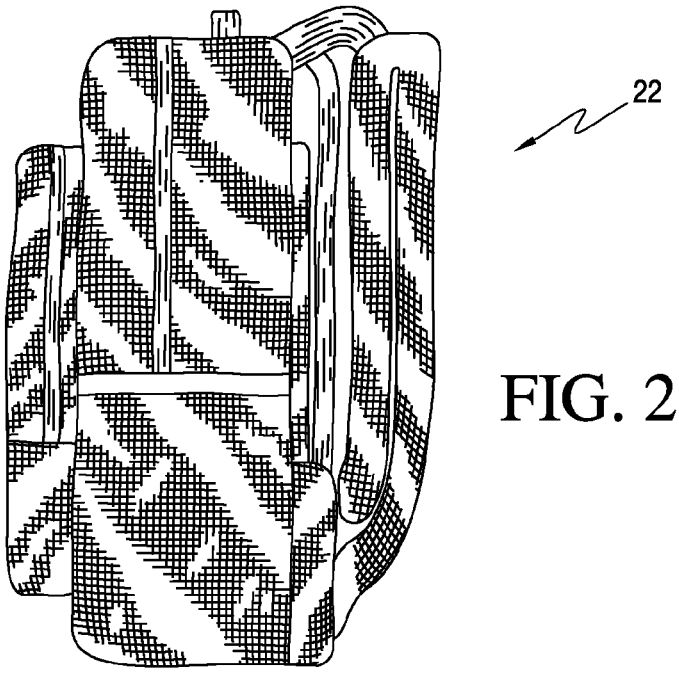
FIG. 2A is a side view of a backpack with a pleated cushion attached to the lower edge of the backpack.

An alternative embodiment shown in FIG. 2A has the pleated cushion 24 attached to the lower edge of the backpack 30, but folded up and against the back panel 30 for storage between the pack assembly 22 and the back of an individual. Any suitable means as for example snap fasteners or hook and loop (Velcro®) fasteners may be used to maintain the pleated cushion in the folded position. By contrast, the pleated cushion 24 as shown in FIGS. 1 and 2 may be held in place by a strap 36. Nevertheless, the pleated cushion could be held in a relatively tight roll by snap fasteners, hook and loop fasteners or other conventional means.

Figure 3:
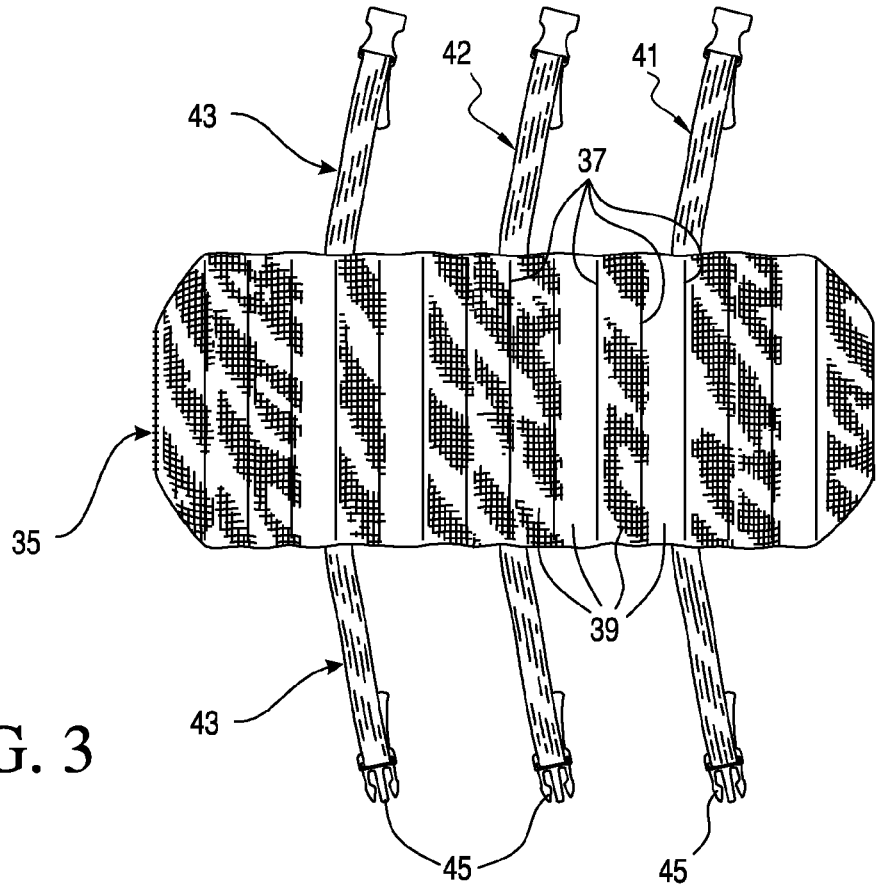
FIG. 3 is a top or plan view of a pleated cushion in accordance with a preferred embodiment of the invention.

With respect to FIG. 3, the pleated cushion 24 is illustrated as a longitudinally extending mat like structure with a length of about 90 cm (about 36 inches) and a width of about 37 cm (about 15 inches). The structure includes a plurality of laterally extending pleats 37 that define a plurality of laterally extending pockets 39. Each of the pockets 39 is filled with an elastomer or preferably a medium density sponge like material 40 and closed on both ends thereof.

A plurality of belts, preferably three belts, 41, 42, and 43 as shown are fixed to and extend outwardly form the mat like structure in a direction that is generally perpendicular to the axis of the longitudinal mat and parallel to the transverse pockets. Each of the belts is fixed to a back surface of the mat and includes a conventional quick release buckle 45. For example, the buckle 45 may be plastic with two forwardly extending prongs and a receptacle with an open area on two sides thereof that allow the prongs to be squeezed together toward one another to open the buckle. The buckles also include a conventional adjustment means such as a pair of superimposed plates in slideable engagement with one another and openings therein for receiving one end of the belts.

Figure 4:
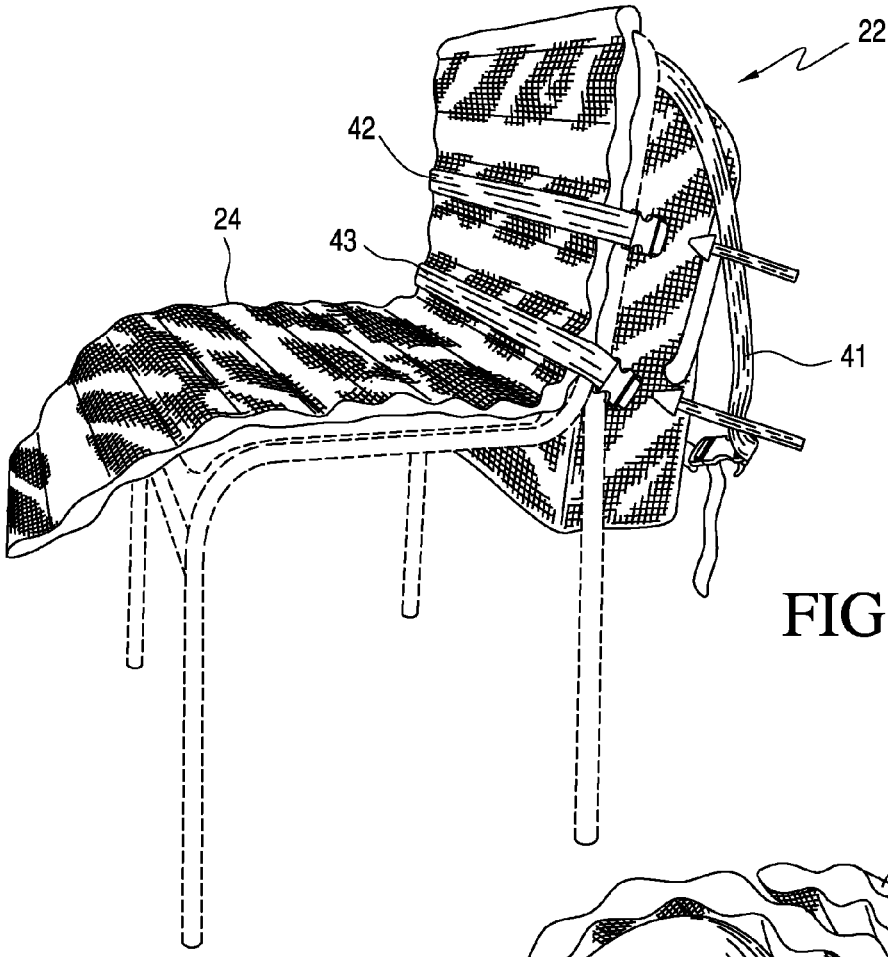
FIG. 4 is a perspective view of a backpack and pleated cushion in accordance with the present invention as used on a chair.

The use of a backpack with a pleated cushion attached thereto 20 is shown in FIG. 4 wherein the cushion 24 and pack assembly 22 hang over a chair back with the pack assembly on the back of the chair back and the cushion 24 strapped to the front of the chair with the straps or belts 41, 42, and 43. The cushion 24 extends over the seat to create a comfortable padded chair.

Figure 5:
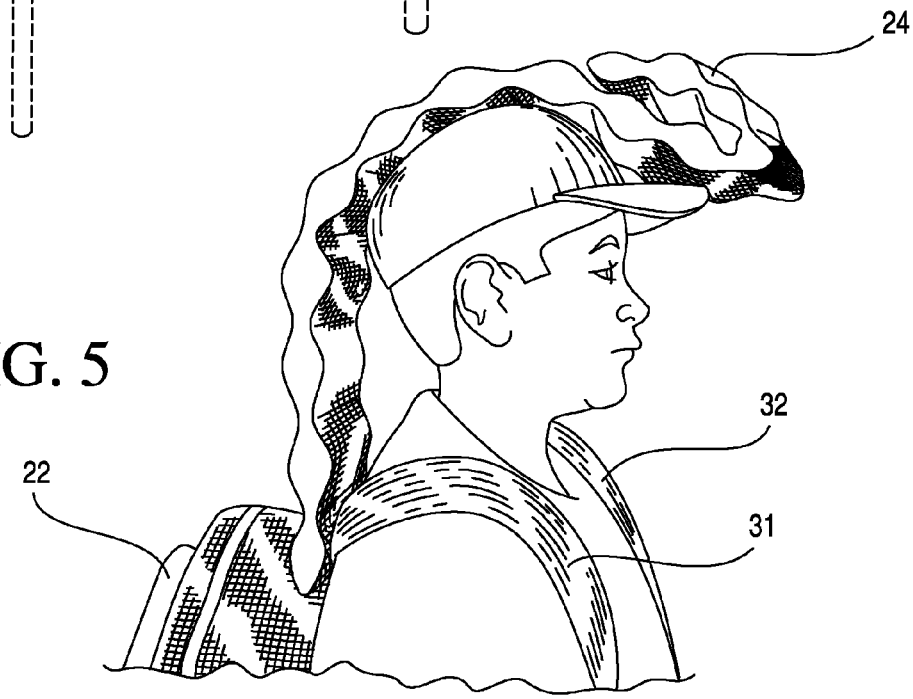
FIG. 5 is a side view of an individual using the backpack and pleated cushion of the present invention for protection from sun, rain, sleet and/or hail.
Figure 6:
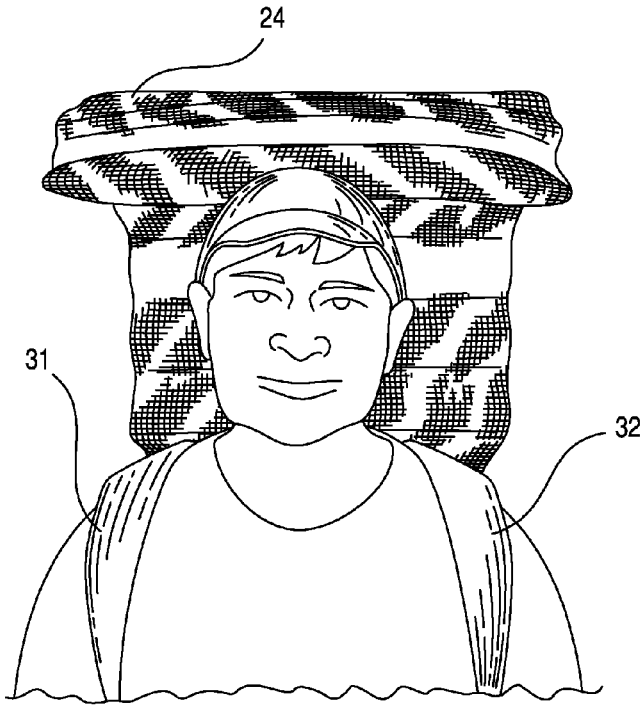
FIG. 6 is a front view of an individual as shown in FIG. 5 with the backpack and pleated cushion of the present invention provided to protect the individual from sun, rain, sleet and/or hail.
Figure 7:
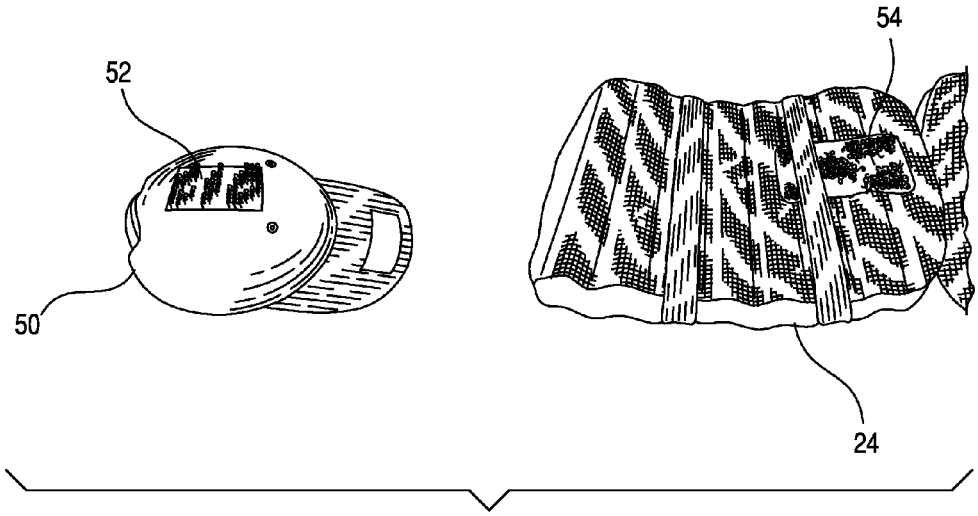
FIG. 7 is a perspective view of a baseball cap and backpack and pleated cushion as used in one embodiment of the invention.

The backpack and attached cushion 20 has other applications. For example, as illustrated in FIGS. 5-7 the pleated cushion 24 can be extended upwardly, forwardly and rearwardly and positioned on top of an individual's head to protect the individual from the sun, rain, sleet or hail. In a preferred embodiment of the invention the backpack with pleated cushion 20 is combined with a hat or cap 50 that includes a hook and loop pad 52 attached to the top of the hat. The cushion 24 is folded over upon itself and held together by the straps or belts 41-43 and includes a matching hook and loop pad 54 to maintain the cushion 24 on top of an individual's head.

While the invention has been described in connection with its preferred embodiments it should be recognized that changes and modifications may be made therein without departing from the scope of the appended claims.

What is claimed is:

1. A multi-functional backpack and pleated cushion and cap assembly comprising:

a backpack portion including a front panel with a front surface and a front pouch attached to said front surface, a back panel, side panels and a bottom panel, and a closable chamber enclosed by said front panel, back panel, side panels and bottom panel;

a pair of shoulder straps secured to said backpack such that with said straps positioned over the shoulders of an individual, said front panel and said back panel are generally parallel to the back of the individual;

a longitudinally extendable pleated cushion attached to said backpack portion and including a plurality of laterally extending fillable pockets and a plurality of laterally extending pleats separating said fillable pockets from one another and wherein said pleated cushion is constructed and dimensioned to fold on said pleats into a plurality of shapes and to be rolled up in a roll when not in use, a first hook and loop pad located on the exterior of the cushion;

a strap for holding the pleated cushion in the rolled condition;

a medium density sponge material filling each of said fillable pockets;

a cap that includes a second hook and loop pad attached to the top of said cap for mating with the first hook and loop pad;

and wherein said pleated cushion is constructed and arranged to fold upwardly, forwardly, and backwardly over the head of an individual to provide shade and/or to protect the individual's upper body from the elements, and the first and second hook and loop pads mating to hold the cushion in place on the hat.

2. A multi-functional backpack and pleated cushion assembly consisting of:

a backpack portion consisting of a front panel with a front surface and a front pouch attached to said front surface, a back panel, side panels and a bottom panel, and a closable chamber enclosed by said front panel, back panel, side panels and bottom panel;

a pair of shoulder straps secured to said backpack such that with said straps positioned over the shoulders of an individual, said front panel and said back panel are generally parallel to the back of the individual;

a longitudinally extendable pleated cushion attached to said backpack portion and consisting of a plurality of laterally extending fillable pockets and a plurality of laterally extending pleats separating said fillable pockets from one another and wherein said pleated cushion is constructed and dimensioned to fold on said pleats into a plurality of shapes and to be rolled up in a roll when not in use, a first hook and loop pad located on the exterior of the cushion;

a strap for holding the pleated cushion in the rolled condition;

a medium density sponge material filling each of said fillable pockets;

a cap that includes a second hook and loop pad attached to the top of said cap for mating with the first hook and loop pad;

and wherein said pleated cushion is constructed and arranged to fold upwardly, forwardly, and backwardly over the head of an individual to provide shade and/or to protect the individual's upper body from the elements, and the first and second hook and loop pads mating to hold the cushion in place on the hat.

* * * * *